United States Patent [19]

Thomas et al.

[11] Patent Number: 4,989,801

[45] Date of Patent: Feb. 5, 1991

[54] ADHESIVE NOTE ROLL AND DISPENSER

[75] Inventors: Paul R. Thomas; William J. Scott, both of Taylorville, Ill.

[73] Assignee: Notepen, Inc., Okla.

[21] Appl. No.: 179,886

[22] Filed: Apr. 11, 1988

[51] Int. Cl.[5] ..... B65H 19/00

[52] U.S. Cl. ..... 242/55.530; 206/407; 206/409; 225/45

[58] Field of Search ..... 242/55.2, 55.53; 225/46, 47, 56, 66, 77, 45, 44; 206/403, 404, 407, 409, 411, 416; 428/43, 343, 194, 906; 401/52, 195

[56] References Cited

U.S. PATENT DOCUMENTS

| | | | |
|---|---|---|---|
| 640,543 | 1/1900 | Donning | 242/55.53 |
| 870,445 | 11/1907 | Livermore | 242/55.53 |
| 1,013,715 | 1/1912 | Yuste | 206/407 |
| 1,107,747 | 8/1914 | Bayer | 242/55.53 |
| 1,322,966 | 11/1919 | Sinclair | 401/52 |
| 2,031,033 | 2/1936 | Denebeim | 225/44 X |
| 2,170,147 | 8/1939 | Lane | 428/43 X |
| 2,589,202 | 3/1952 | Newman | 428/194 X |
| 2,977,798 | 4/1961 | Dean | 401/52 X |
| 4,069,958 | 1/1978 | Strauss | 242/55.53 X |
| 4,327,875 | 5/1982 | Lightfoot | 242/55.53 |

*Primary Examiner*—Daniel P. Stodola

*Attorney, Agent, or Firm*—Finnegan, Henderson, Farabow, Garrett & Dunner

[57] ABSTRACT

A note roll (A,C) is disclosed for a dispensing device, (10,30) the note roll includes paper having a first side (11*a*) which is clean for note writing. A second side (11*b*) of the paper includes a self-stick adhesive strip (B,B') by which indeterminate or pre-determined lengths of paper may be dispensed from the roll with sufficient self-stick adhesive for attachment to a desired surface. Self-stick adhesive (B) is disposed on the paper of the note roll along its length and down a medial portion so that paper may be dispensed in indeterminate lengths with a strip of adhesive along the back. Multiple pre-determined pieces (13) of paper may be dispensed at one time or may be torn at perforations (12).

6 Claims, 2 Drawing Sheets

ADHESIVE NOTE ROLL AND DISPENSER

BACKGROUND OF THE INVENTION

The invention relates to roll note paper having a self-stick adhesive which allows paper to be dispensed from the roll at indeterminate or predetermined lengths with adhesive on one side to attach a written note to a desired surface.

In the past, Post-It TM brand note pads have been made by the 3M Company of St. Paul, Minnesota. Individual sheets are included on the pad having a self-adhesive layer adjacent the top of each sheet. However, in some applications, the pad form of note paper is not suitable. For example, U.S. Pat. No. 2,601,650 discloses a roll of note paper dispensed from a pen. Generally, paper of this type may be dispensed in determinate quantities as opposed to the predetermined quantity in a pad. It becomes a problem of locating the position of adhesive across the roll paper so that suitable adhesive may be on the paper on the point of paper dispensing. Other type dispensers have been used for dispensing a roll of paper. However, none of the prior dispensing devices, nor the paper rolls, have been entirely satisfactory for the combination of a paper roll and dispenser which dispenses self-adhesive paper roll in either predetermined or indeterminate lengths.

Accordingly, an object of the invention is to provide a paper note roll and dispenser for dispensing paper in indeterminate lengths with adhesive on the dispensed paper for attachment to a surface.

Another object of the invention is to provide a paper note roll for dispensing paper in predetermined and indeterminate lengths with adhesive on any length for attachment to any surface.

Another object of the invention is to provide a self-adhesive note roll and dispenser for dispensing lengths of paper with adhesive for attachment to a surface.

SUMMARY OF THE INVENTION

The above objectives are accomplished according to the present invention by providing a paper roll on which notes may be written on one side having self-stick adhesive opposed on a second side. Preferably, the paper is rolled up on the adhesive side of the paper. By this means, the paper is held intact and compact in roll form. The adhesive does not interfere with the dispensing surfaces against which the paper may be unrolled. A narrow width of self-stick adhesive placed down a medial portion of a note paper roll along the entire length permits paper to be dispensed in indeterminate lengths with adhesive on any length for attachment. Perforations may also be used at predetermined lengths across the roll with a lateral strip of self-stick adhesive below the perforations. A dispenser for the note roll paper includes a barrel in which the note paper is received having a supply slot from which the paper may be unwound. A rotational sleeve fits over the barrel and includes a dispensing slot against which the paper may be torn for dispensing at predetermined or indeterminate lengths.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DESCRIPTION OF A PREFERRED EMBODIMENT

Figure 3:
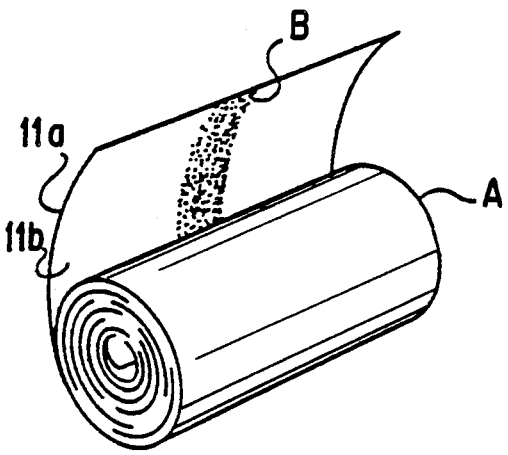
FIG. 3 is a perspective view of a self-adhering note paper roll according to the invention.

Referring now in more detail to the drawings, a dispenser device, designated generally as 10, is shown for dispensing a paper form a note roll A. As can best be seen in FIG. 3, note roll A preferably includes a narrow strip of self-stick adhesive B extending lengthwise along the roll along its medial portion. Adhesive B may be any suitable self-stick adhesive, like, for example, that used on the Post-It TM brand note pads available from the 3M Company of St. Paul, Minnesota. While adhesive B is shown in a continuous strip down the length of the paper, it may also be placed at spot intervals so that indeterminate lengths of paper may be torn from the roll with each having at least some adhesive on the severed piece. A first side 11*a* of paper P is clean for written notes. A second side 11*b* carries adhesive B,B'.

Figure 4:
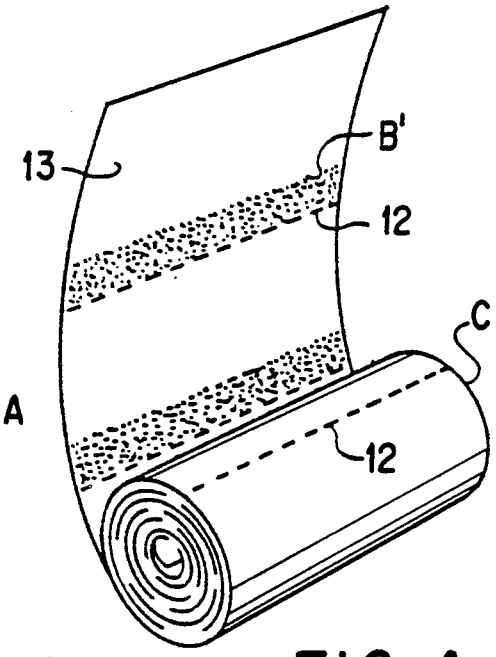
FIG. 4 is a perspective view of another embodiment of a self-adhering note paper roll according to the invention.

Another embodiment of the invention can best be seen in FIG. 4. In this embodiment, a paper roll C is shown having adhesive B' across the paper in the roll rather than lengthwise. In roll C, perforations are formed so that one or more predetermined lengths of note paper are provided upon dispensing. A narrow, lateral strip of self-stick adhesive B' is located below each perforation 12.

Figure 1:
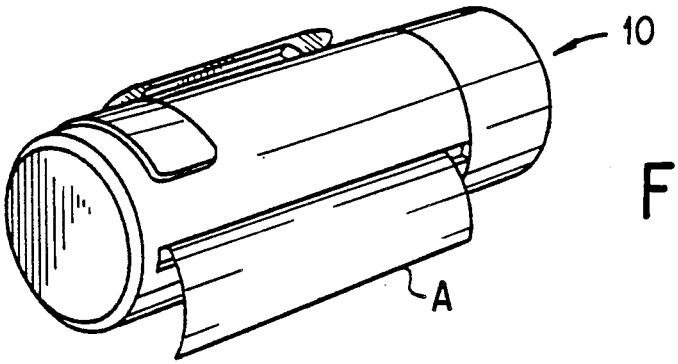
FIG. 1 is a perspective view of a self-adhesive note roll and dispenser according to the invention.
Figure 2:
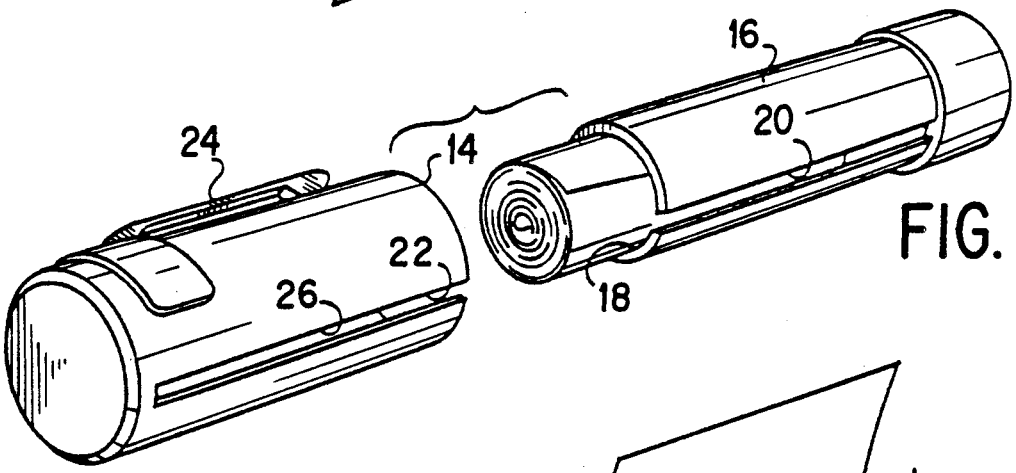
FIG. 2 is a perspective view of FIG. 1 with parts separated.

As can best be seen in FIGS. 1 and 2, dispenser 10 preferably includes a dispensing cap 14 and a dispensing barrel 16. Barrel 16 includes a hollow interior 18 and a supply slot 20 formed longitudinally. A dispensing slot 22 is formed in the end cap 14. A pocket clip 24 may be attached to cap 14 for carrying the note roll and dispenser in the pocket. When supply slot 20 and dispenser slot 22 are aligned, paper may be unrolled from note roll A,C. When dispensing slot 22 covers supply slot 20 so that paper is squeezed, the paper may be easily torn across the edge 26 of dispensing slot 22. In the case of roll A, any indeterminate length of paper may be withdrawn from the roll and severed against edge 26 for dispensing. In this case, self-stick adhesive B will be on the back of any length so that attachment of the note paper may be had to a surface. In case of roll C, note paper may be torn in lengths corresponding to one perforation or multiple perforations with multiple lateral self-stick adhesive strips on the back of the paper. In this manner, indeterminate lengths of note paper may be dispensed from either roll A,C with sufficient self-stick on the back for adherence to a desired surface.

Overlapping of dispensing slot 22 past the supply slot 20 keeps the supply slot closed and maintains a sufficient length of paper held between barrel 16 and cap 14. This procedure is described in more detail in applicant's co-pending parent application U.S. Ser. No. 113,445 entitled NOTE PAPER DEVICE filed on Oct. 28, 1987.

Figure 5:
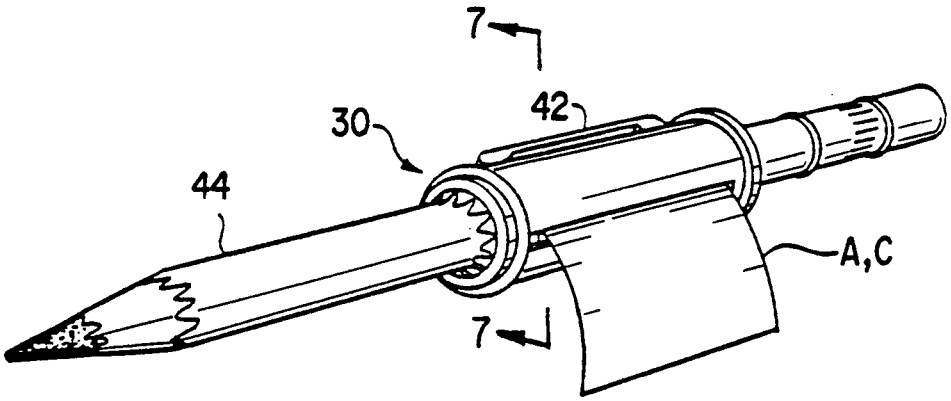
FIG. 5 is a perspective of another embodiment of a self-adhering paper roll and dispenser according to the invention.
Figure 6:
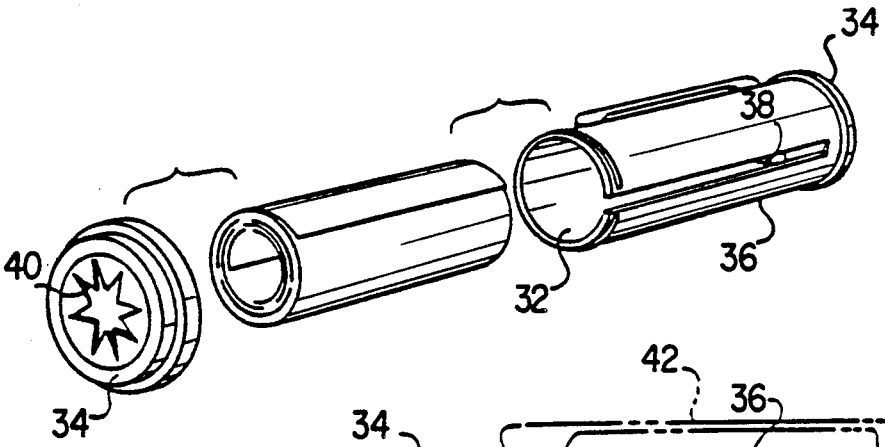
FIG. 6 is a perspective view with parts separated of the note roll and dispenser of FIG. 5.
Figure 7:
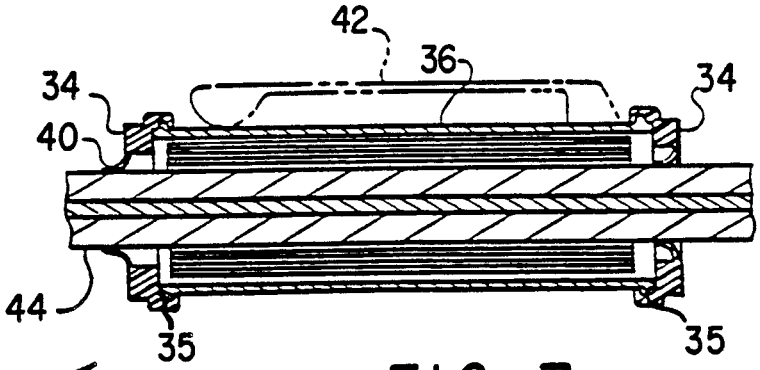
FIG. 7 is a sectional view taken along line 7—7 of FIG. 5.

As can best be seen in FIGS. 6 and 7, another embodiment of an advantageous dispensing device is illustrated and is designated generally as 30. Dispensing device 30 has a hollow interior 32. Two end caps 34 are snapped onto lips 35 at the ends of a dispensing barrel 36. There is a supply slot formed in barrel 36. A sleeve which operates like cap 14 in FIG. 2 may also be applied and may be rotatably received on barrel 36 having a dispensing slot like that of 22. End caps 34 have a plurality of resilient projections 40 extending radially inward. These projections are sufficient resilient to engage and grip a pencil or other writing instrument, as can best be seen in FIGS. 5 and 7. This engagement holds the dispensing device on the pencil. A pocket clip 42 may also be utilized to mount both the writing instrument and dispensing device with note roll on a pocket. Note roll A,C may be used in the barrel 36. The note roll may be inserted in the barrel with one end cap off, and barrel 36 either on or off the pencil. The end cap is then snapped onto the barrel. A pencil 44 may be inserted through the center of note roll and the barrel 36 coming out the opposing end cap. Both the note roll and the barrel are then concentric with the barrel. The paper may be unrolled from the roll and dispensed through slot 38 in any length with self-stick adhesive on the back side for adherence.

Figure 8:
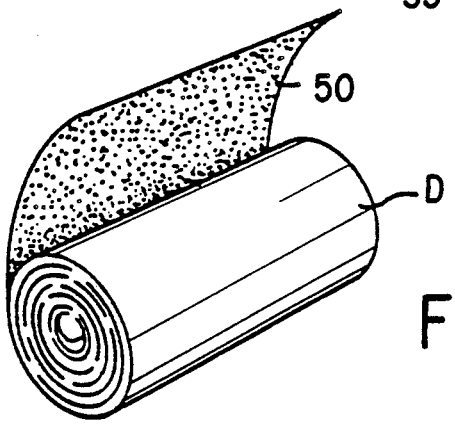
FIG. 8 is another embodiment of a self-adhering paper roll according to the invention.

Another embodiment of a note roll is illustrated in FIG. 8 wherein an adhesive backing 50 is carried on roll D. In this case, self-stick adhesive is not utilized, but an adhesive which must be moistened before it will stick is utilized. This may be advantageous in many applications.

While a preferred embodiment of the invention has been described using specific terms, such description is for illustrative purposes only, and it is to be understood that changes and variations may be made without departing from the spirit or scope of the following claims.

What is claimed is:

1. A note roll dispensing device comprising:

a note roll of continuous length paper;

self-stick adhesive carried along a length of said paper on a second side of said roll;

a first side of said note roll having a clean surface for written notes, dispensing means for dispensing said paper from said note roll in indeterminate lengths so that notes may be written on said first side which sufficient self-stick adhesive is located on said second side;

said dispensing means including a hollow barrel which accommodates said note roll of paper having first and second ends;

a first end cap carried on said first end of said barrel;

a second end cap carried on said second end of said barrel;

aligned central openings carried by each of said first and second end caps for receiving a writing instrument;

retaining means for affixing said hollow barrel concentrically upon said writing instrument;

a paper dispensing slot formed in said barrel through which paper from a note roll concentric with said writing instrument may be pulled from said roll and dispensed from said barrel;

said first end cap being removable for reloading said hollow barrel with a note roll; and said retainer means including resilient means carried by said first and second end caps biased against said writing instrument.

2. The device of claim 1 wherein said self-stick adhesive is disposed on said second side of said note roll in a narrow strip along a medial portion of said note roll.

3. The device of claim 2 wherein said self-stick adhesive extends continuously along said medial portion over generally the entire length of said note roll along said second side.

4. The device of claim 1 wherein said dispensing device further includes:

a plurality of resilient radial projections carried by each of said end caps extending into said central opening for resilient gripping of a writing instrument inserted through said end caps providing said resilient means.

5. The device of claim 1 wherein said note roll includes a plurality of perforations formed across its width and extending along its length; and a plurality of self-stick adhesive strips below the perforations extending laterally across its width.

6. The device of claim 1 wherein said dispensing slot terminates in an open end at said first end of said barrel to facilitate threading of a length of paper when reloading said barrel.

* * * * *